US009259939B2

(12) United States Patent
Paschkewitz et al.

(10) Patent No.: US 9,259,939 B2
(45) Date of Patent: Feb. 16, 2016

(54) PRINT HEAD INK FLOW PATH WITH BUBBLE REMOVAL GROOVES

(71) Applicant: Palo Alto Research Center Incorporated, Palo Alto, CA (US)

(72) Inventors: John S. Paschkewitz, San Carlos, CA (US); Emily Tow, Somerville, MA (US); Victor Beck, Menlo Park, CA (US); Kai Melde, Stuttgart (DE)

(73) Assignee: Palo Alto Research Center Incorporated, Palo Alto, CA (US)

( * ) Notice: Subject to any disclaimer, the term of this patent is extended or adjusted under 35 U.S.C. 154(b) by 48 days.

(21) Appl. No.: 14/142,305

(22) Filed: Dec. 27, 2013

(65) Prior Publication Data

US 2015/0183228 A1 Jul. 2, 2015

(51) Int. Cl.
*B41J 2/19* (2006.01)
*B41J 2/14* (2006.01)

(52) U.S. Cl.
CPC ..... *B41J 2/19* (2013.01); *B41J 2002/14169* (2013.01)

(58) Field of Classification Search
CPC ..... B41J 2/19; B41J 2002/14169
USPC ..... 347/92, 65, 93, 99
See application file for complete search history.

(56) References Cited

U.S. PATENT DOCUMENTS

| | | | | |
|---|---|---|---|---|
| 6,019,464 | A | 2/2000 | Tsukada et al. | |
| 6,331,055 | B1 | 12/2001 | Miller et al. | |
| 6,746,106 | B1 * | 6/2004 | Hager | B41J 2/1404 347/47 |
| 7,690,769 | B2 | 4/2010 | Katayama | |
| 2004/0262223 | A1 | 12/2004 | Strook et al. | |
| 2005/0104943 | A1 * | 5/2005 | Hida | B41J 2/18 347/93 |
| 2012/0050424 | A1 * | 3/2012 | Nabeshima | B41J 2/175 347/92 |
| 2013/0162736 | A1 * | 6/2013 | Paschkewitz | B41J 2/19 347/92 |
| 2014/0146110 | A1 * | 5/2014 | Melde | B41J 2/14024 347/65 |

* cited by examiner

*Primary Examiner* — Henok Legesse
(74) *Attorney, Agent, or Firm* — Hollingsworth Davis, LLC

(57) ABSTRACT

A print head includes an inlet port that receives a flow of a phase-change ink and an outlet port that delivers the flow to a jet. The print head includes a flow path along a flow direction from the inlet port to the outlet port. The flow path has top and bottom planar surfaces, and further includes two or more elongated grooves in at least one of the top and bottom planar surfaces. The two or more elongated grooves are at an angle to the flow direction and have a threshold capillary dimension such that bubbles in the phase-change ink are directed along the elongated grooves.

18 Claims, 13 Drawing Sheets

PRINT HEAD INK FLOW PATH WITH BUBBLE REMOVAL GROOVES

BACKGROUND

Ink jet printers can encounter problems with air bubbles that form in the ink. These air bubbles may cause printing defects and in some cases can damage ink jets. In some systems, a purge cycle is used to force air bubbles from the ink flow paths. The resultant purge mass of ink increases the cost per page. As such, it is desirable to minimize the amount of ink used to in removing air bubbles from printer ink.

SUMMARY

The present disclosure is related to ink jet printers. In one embodiment, a print head includes an inlet port that receives a flow of a phase-change ink and an outlet port that delivers the flow to a jet. The print head includes a flow path along a flow direction from the inlet port to the outlet port. The flow path has top and bottom planar surfaces, and further includes two or more elongated grooves in at least one of the top and bottom planar surfaces. The two or more elongated grooves are at an angle to the flow direction and have a threshold capillary dimension such that bubbles in the phase-change ink are directed along the elongated grooves.

In another embodiment, a method involves applying pressure to phase-change ink in a flow path. The flow path includes top and bottom planar surfaces, and further includes two or more elongated grooves in at least one of the top and bottom planar surfaces. The two or more elongated grooves are at an angle to a flow direction and have a threshold capillary dimension such that bubbles in the phase-change ink are directed along the elongated grooves. The method further involves removing the pressure to allow the bubbles to be moved via buoyancy. The applying of the pressure and the removing of the pressure are repeated a plurality of times.

In another embodiment, a print head includes first and second planar flow paths separated by a layer. The first planar flow path includes two or more elongated grooves in a planar surface. The two or more elongated grooves are at an angle to a flow direction of a phase-change ink. The elongated grooves have a threshold capillary dimension that results in a surface tension force acting on bubbles being greater than a force of the flow acting on the bubbles such that the bubbles are directed along the elongated grooves. The print head further includes a via through the layer joining at least one elongated groove of the first planar flow path to the second planar flow path. The bubbles are directed through the via to the second planar flow path by the flow.

These and other features and aspects of various embodiments may be understood in view of the following detailed discussion and accompanying drawings.

BRIEF DESCRIPTION OF THE DRAWINGS

In the following diagrams, the same reference numbers may be used to identify similar/same/analogous components in multiple figures. The drawings are not necessarily to scale.

DETAILED DESCRIPTION

The present disclosure is generally related to print heads that use liquid ink jets. These inks include hot melt inks (also referred to herein as "phase change inks") that are solid at room temperature and melted to a liquid state during use. The features described herein may also be applicable to include print heads using aqueous inks that are liquid at room temperature. Generally, the print heads described herein have features for removing bubbles that become entrapped in ink flows. In phase change inks, bubbles can result from air entrainment during phase change. In aqueous inks, bubbles can become entrapped due to outgassing. In either case, bubbles can negatively affect printer operation. For example, print quality may be affected, and in some cases jets can be damaged as a result of bubbles.

Some inkjet printing systems utilize traps or other features that allow bubbles to settle in a known region, and then the bubbles can later be removed by purging. Generally, purging involves ejecting ink during a non-printing operation, e.g., into a trap or reservoir. While purging can be effective, it consumes ink, and so can be expensive for the end-user. Further, such a process can fail in ink manifolds where bubbles rise to regions that are in stagnation points in the ink flow field, or in regions where the bubble must be strongly distorted to exit through a small vent. The latter can occur for large bubbles.

In embodiments described herein, geometric features are used to trap and guide bubbles to exit vents. These features also allow the removal of bubbles using a minimal amount of ink, thus reducing the "purge mass" or ink waste. Reducing ink usage improves customer satisfaction and reduces operating cost. The bubble diversion features are relatively easy to manufacture, and can be adapted for a wide variety of conditions.

Figure 1:
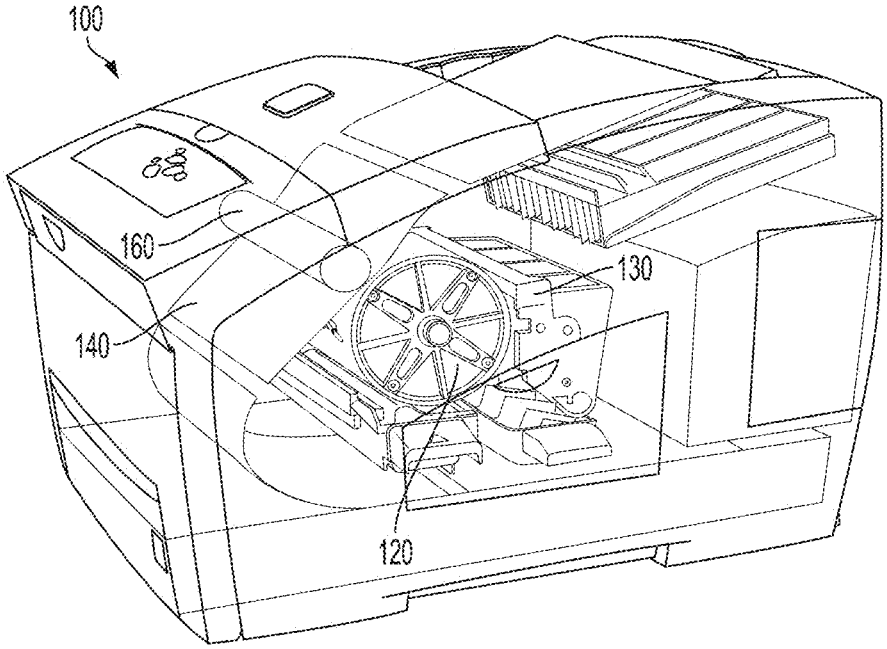
FIG. 1 is a perspective view of an inkjet printer according to an example embodiment.
Figure 2:
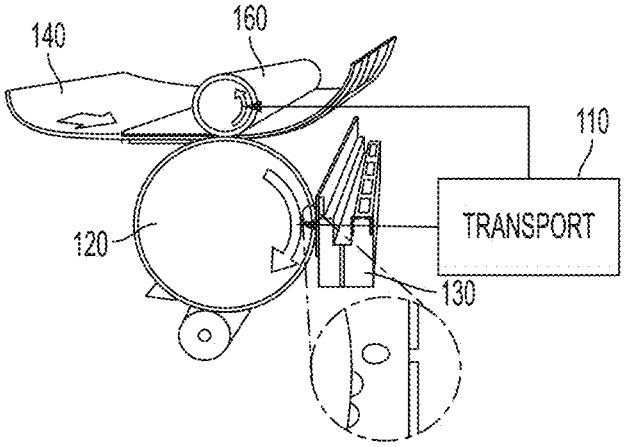
FIG. 2 is a perspective view showing internal details an ink jet printer according to an example embodiment.

In FIGS. 1 and 2, perspective views provide internal details of portions of an ink jet printer 100 that incorporates bubble mitigation features as discussed herein. The printer 100 includes a transport mechanism 110 that is configured to move the drum 120 relative to the print head 130 and to move the paper 140 relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the paper 140 travels around the drum 120, the pattern of ink on the drum 120 is transferred to the paper 140 through a pressure nip 160.

Figure 3:
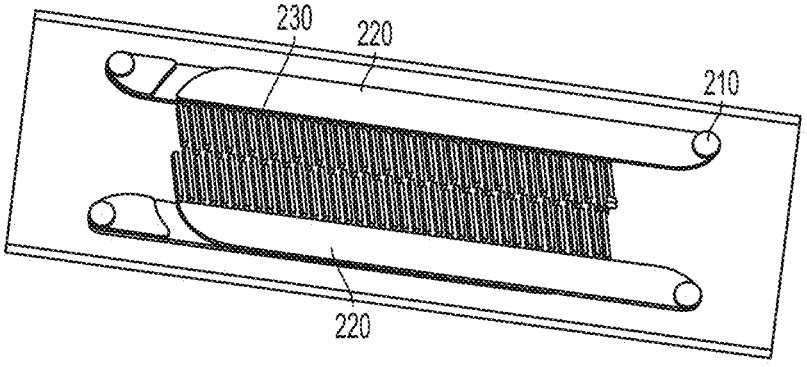
FIGS. 3 and 4 are perspective views showing details of a print head according to an example embodiment.
Figure 4:
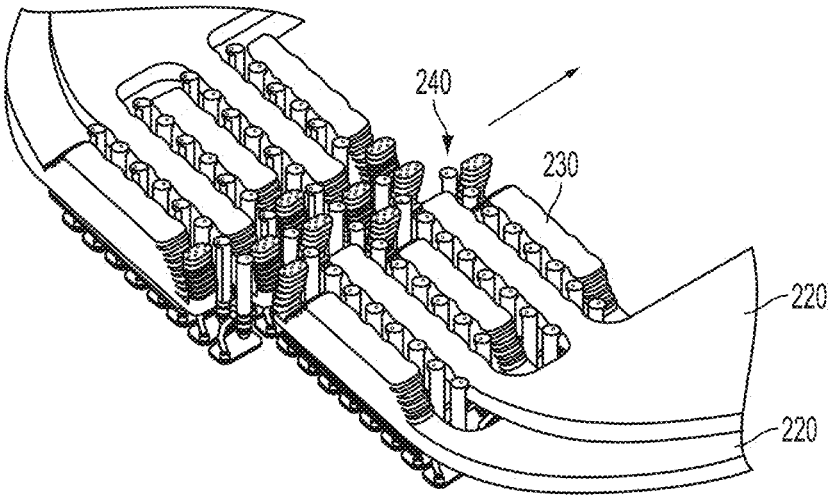

In FIGS. 3 and 4, perspective views show details of a print head according to an example embodiment. The path of molten ink, contained initially in a reservoir, flows through a port 210 into a main manifold 220 of the print head. As best seen in FIG. 4, in some cases, there are multiple manifolds 220 which are overlaid, e.g., one manifold 220 per ink color. Each of these manifolds 220 connects to interwoven finger manifolds 230. The ink passes through the finger manifolds 230 and then into the ink jets 240. The manifold and ink jet geometry illustrated in FIG. 4 is repeated in the direction of the arrow to achieve a desired print head length, e.g. the full width of the drum.

Figure 5:
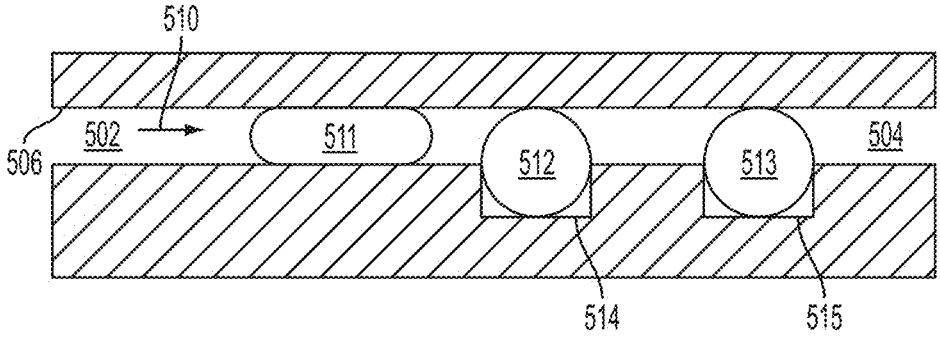
FIG. 5 is a cross-sectional view showing a manifold region that facilitates bubble management according to an example embodiment.
Figure 6:
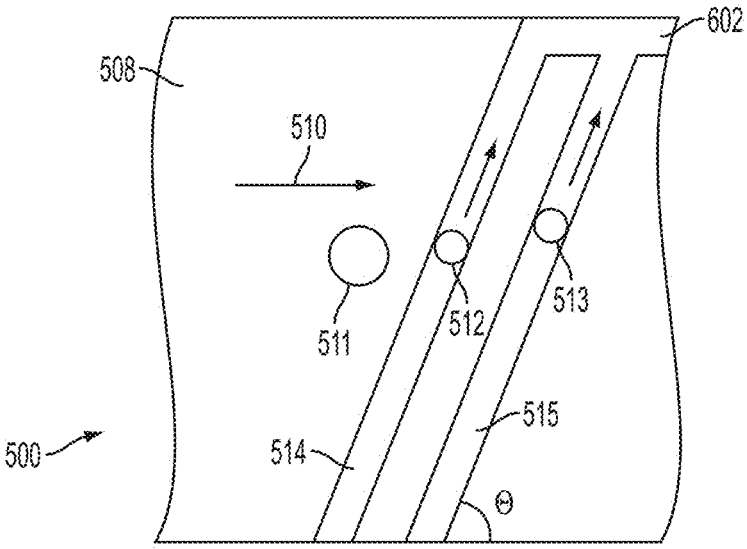
FIG. 6 is a plan view of the manifold region shown in FIG. 5.

In some examples discussed in this disclosure, the print head may use piezoelectric transducers (PZTs) for ink droplet ejection. However, the bubble mitigation approach described herein may be used for devices that employ other methods of ink droplet ejection. In FIG. 5, a cross-sectional view shows a manifold region 500 that facilitates bubble mitigation according to an example embodiment. In FIG. 6, a bottom surface 508 of the manifold region 500 is shown in a top down view. The manifold region 500 is generally part of an ink jet print head, and may be located anywhere between an input port that receives a flow of ink (e.g., phase-change ink) and an outlet port that delivers the flow to a jet. The ink may be supplied from a reservoir, and in the case of a phase-change ink, may be heated to facilitate ink flow.

The manifold region 500 generally includes an inlet port 502 that receives ink and an outlet port 504 that delivers ink. A pressure differential between the inlet port 502 and outlet port 504 drives the flow of ink. The manifold region 500 includes top and bottom planar surfaces 506, 508 that define boundaries of the flow path. The ink flows in a flow direction 510 indicated by the arrow. The term "top" and "bottom" as used relative to surfaces 506, 508 is not intended to limit the manifold 500 or flow direction 510 in any particular orientation to gravity. For example, the ink flow may, in some embodiments, be driven by buoyancy or convection, in which case the gravitational vector would be at least partially aligned with the flow direction 510.

In this example, bubbles 511-513 traveling through the flow path of the manifold region 500 are sized such that the bubbles are distorted when located between the top and bottom surfaces 506, 508, as seen with bubble 511. This distortion may make it difficult to move the bubble 511 along the flow direction 510 due to surface tension forces. To assist in removing bubble of this type, the manifold 500 includes elongated grooves 514, 515 disposed in the bottom surface 508. The elongation of the grooves is best seen in FIG. 6. Similar grooves may be disposed on the top surface 506 instead of or in addition to the illustrated grooves 514, 515.

The grooves 514, 515 are oriented at an acute angle to the direction 510 of the ink flow. This angle $\theta$ can be seen in FIG. 6, where $0 \leq \theta < 90$ degrees. In more particular embodiments, $0 \leq \theta \leq 85$ degrees. It will be understood that if $\theta > 90$ degrees in the illustrated view, then another acute angle $\beta$ will be formed between the grooves 514, 515 and flow direction 510, such that $0 \leq \beta < 90$ degrees (e.g., $0 \leq \beta \leq 85$ degrees). In such a case, the bubbles 512, 513 would be moved down and to the right instead of up and to the left as shown.

Generally, while the grooves 514, 515 may still entrap bubbles if $\theta = 90$ degrees, the primary ink flow may not have a significant component of force perpendicular to the flow direction. As such, the bubbles in a perpendicular groove may not be moved out by the ink flow alone. However, perpendicular grooves may be used to remove bubbles, for example, if a secondary flow is introduced into the grooves 514, 515 and/or the grooves 514, 515 are oriented such that other forces such as buoyancy or convection moves the bubbles 512, 513 along the grooves 514, 515.

The grooves 514, 515 have a threshold capillary dimension that results in a surface tension force acting on bubbles 512, 513 being greater than a force of the flow acting on the bubbles. As such, the flow can direct the bubbles away from the outlet port 504. As seen in FIG. 6, the bubbles 512, 513 are directed to a removal channel 602 that can, for example, vent and/or trap the bubbles. In the latter case, the bubbles may be held in a region where they can be quickly purged using a minimal amount of ink.

While a single elongated groove may be used, it has been observed that under some flow conditions, the bubbles may skip across a groove. For example, the bubble may be larger than the groove and only part of the bubble is captured by the groove. In other cases, the bubble may have a diameter smaller than or of comparable size to the main flow channel such that the bubble surface energy is not reduced by expansion into the groove and the bubble flows past it. Even though the bubble may skip one groove, the groove may slow the bubble down somewhat, and so by having additional grooves downstream along the flow path, the bubble may eventually be slowed down enough so that bubbles break up or coalesce with other bubbles, thereby becoming entrapped in one of the downstream grooves. Thereafter, the bubbles will remain in the groove due to surface tension forces acting on bubbles being greater than a force of the flow, at least in the direction of the flow.

Figure 7:
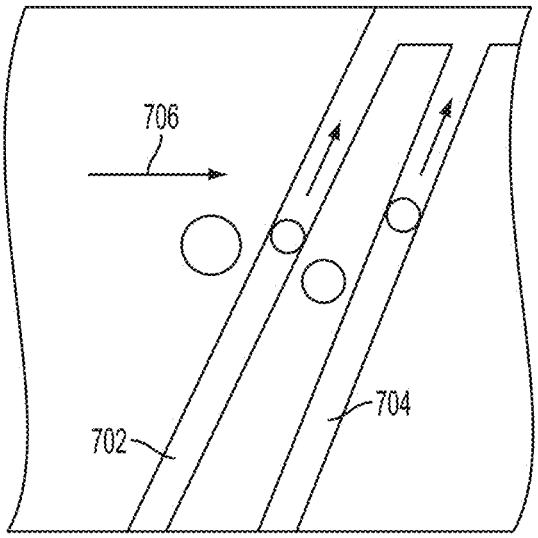
FIGS. 7 and 8 are block diagrams illustrating elongated grooves according to other embodiments.
Figure 8:
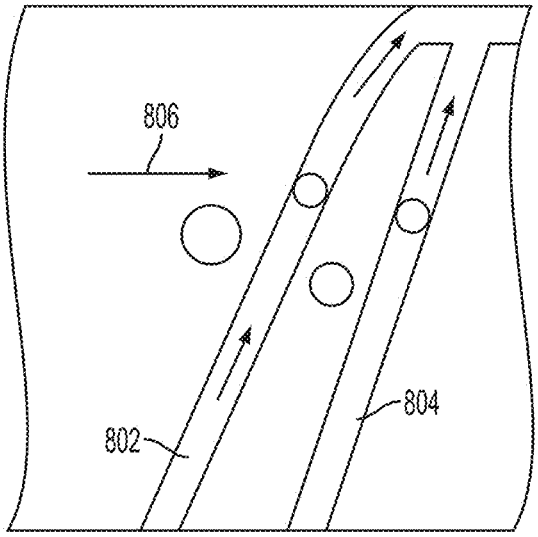

In FIGS. 7 and 8, block diagrams illustrate variations on the groove arrangement shown in FIG. 6. In FIG. 7, grooves 702, 704 are at different angles to the flow direction 706. In FIG. 8, grooves 802, 804 are at the same angle to the flow direction 806 near the bottom, but groove 802 has a gradual curve near the top. In both of these figures, the use of different groove angles and groove shapes can, among other things, account for regions of differing flow pressure and account for the effects of upstream grooves on the bubbles. It will be understood that many variations of groove geometry may be used. For example, a combination of parallel or non-parallel grooves may be employed, and the grooves may be any combination of straight or curved.

The principle of operation is that grooves in the wall(s) of a larger channel combined with a flow of liquid through the channel guide bubbles in a particular size range down the groove. Surface tension forces drive bubbles into the grooves minimizing the total surface energy of the interface. Once lodged into a groove, the flow upstream of the bubbles imparts viscous shear and pressure forces on the bubble. The walls of the groove provide a reaction force against the bubble that partially balances the net hydrodynamic force. The resultant net force on the bubble is thus resolved parallel to the groove.

The bubble remains trapped so long as the surface tension forces of the bubble in the groove are not overcome by the hydrodynamic forces from the impinging flow. The surface tension force at any point along the bubble depends on the local curvature of the bubble. Since a trapped bubble is lodged in the groove an appropriate scaling of this force may be expressed as shown in Equation [1] below, where σ is the surface tension of the bubbles and w is the smallest length scale of the bubble. Because the bubble is trapped in the groove, w will be of the same size as the smallest scale of the groove. For example, w is the groove width for deep grooves but is the groove depth when the groove depth is smaller than the groove width.

$$F_{surface_tension} \approx \text{Surface Tension} * \text{Typical Length} = \sigma * w \quad [1]$$

The surface tension force described in Equation [1] is balanced by the hydrodynamic forces acting on the upstream side of the bubble. The hydrodynamic forces include pressure forces and viscous shear forces. Since the bubble is translating down the groove, the viscous shearing forces act primarily in the thin gaps between the bubble and the wall. More importantly, there is an associated pressure build-up upstream of the bubble. This pressure force will scale as shown below in Equation [2], where μ is the fluid viscosity, L is the bubble length, U is the characteristic fluid velocity in the flow path, and H is the flow path height.

$$\begin{aligned} F_{pressure} &\approx \text{Pressure on Bubble} * \text{Bubble Area Exposed to Flow} \quad [2] \\ &= \mu U / L * LH \\ &= \mu UH \end{aligned}$$

For the bubble to remain lodged in the groove, $F_{pressure} < F_{surface_tension}$. Substituting from [1] and [2], this can be expressed as in Equation [3], where Ca is the dimensionless Capillary number, and defines a threshold operating condition for bubbles to remain trapped in and guided by the grooves.

$$Ca = F_{pressure}/F_{surface_tension} = \mu UH/\sigma * w < 1 \quad [1]$$

In order to validate this result, commercial computational fluid dynamics (CFD) software (Star-CCM+, CD-Adapco) was used to calculate the steady profile of a typical grooved channel as depicted in FIGS. 5 and 6. The angle of the groove was held fixed at 45 degrees but the width and depth were allowed to vary. All of the simulations were conducted for conditions where the Reynolds number in the channel is much smaller than one, Re<<1, which is representative of ink flows in a print head for use conditions other than high pressure ink purge.

Figure 9:
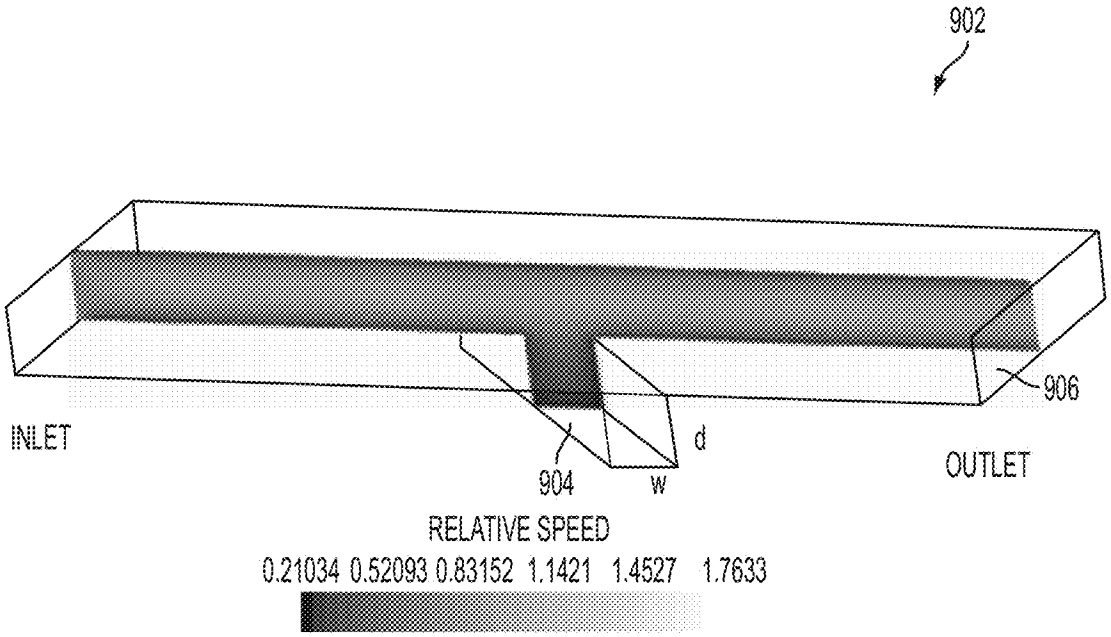
FIG. 9 is a three-dimensional flow diagram showing modeling results for a bubble-removal groove in a planar manifold according to an example embodiment.

The presence of the groove can alter the hydrodynamics of the channel in two ways. First, the groove may induce a secondary flow along the groove. Secondly, the groove can change the overall pressure drop in the channel. The pressure drop change is typically smaller than the secondary flow, as flow in the groove is driven by viscous forces from the channel flow above it. This is confirmed experimentally since the bubble speed along the groove is approximately equal to the component of upstream channel velocity projected parallel to the groove. In FIG. 9, three-dimensional flow diagrams show CFD modeling results for a bubble-removal groove in a planar manifold according to an example embodiment.

In diagram 902, a contour plot shows geometry and velocity for a single cross section along the length of manifold flow path 906 near elongated groove 904. The flow is from left to right in the figure. The flow path height is depicted as height H, and groove depth and width are depicted as d and w, respectively. The flow path 906 is 4H wide and 14H long. The groove 904 is at 45 degrees relative to the main flow path 906. The relative velocity is defined as the ratio of the velocity relative to the average velocity $v_{avg}=Q/4H^2$. The cross section is shaded by the magnitude of the velocity parallel to the channel length. Note that the velocity in the channel is lower than the flow speed above the channel.

Figure 10:
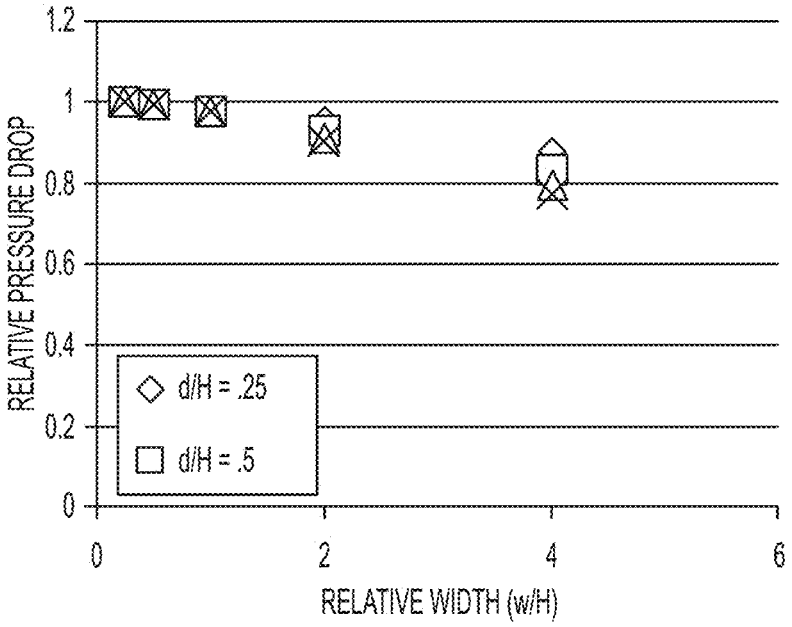
FIG. 10 is a graph of predicted pressure drop of a channel with grooves of various widths and depths according to example embodiments.

To assess the impact of grooves on the overall hydrodynamics of the print head, an analysis was performed to calculate the pressure drop of a channel with grooves of various widths and depths. The results of this analysis are seen in the graph of FIG. 10. In the graph, relative pressure drop in the channel is shown as a function of varying groove width and depth. The relative pressure drop is defined as the ratio of the pressure drop in the grooved channel to the pressure drop in a channel without a groove. Here w is the channel width, H is the channel height, and d is the channel depth. Note that for all of the grooves studied the pressure drop is always less than or equal to the pressure drop in the "groove-free" channel. As a result, the presence of the groove lowers the hydrodynamic resistance in the channel.

In the absence of significant secondary flow (vortex) generation in the primary flow channel, the effect of the grooves is to increase the effective channel size (or hydraulic diameter) and the required pressure drop is lower. This decreased pressure drop may be an added benefit, because pressure drop budget in the ink manifolds is generally limited. Using more grooves allows efficient trapping and steering of bubbles and further reduces the overall pressure drop in the manifold passage of interest.

Figure 11:
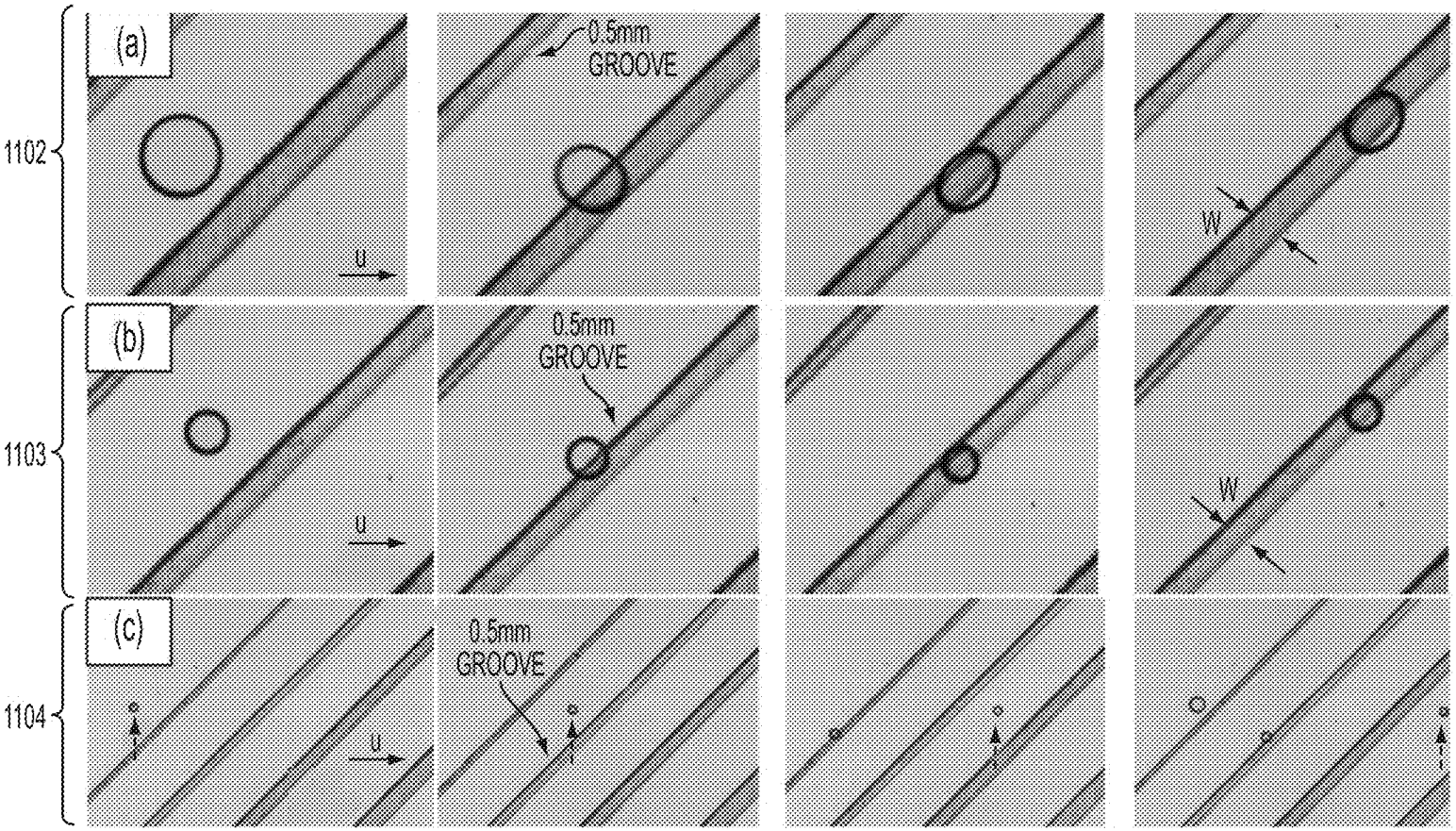
FIG. 11 is a series of photographs illustrating trapping performance of elongated grooves according to an example embodiment.

In reference now to FIG. 11, a series of photographs illustrate trapping performance of elongated grooves according to an example embodiment. The photographs were taken in an experimental fixture having a set of three channels of fixed depth but increasing width. Each sequence 1102-1104 of photographs includes four, time sequential images that follow one bubble travelling across a channel. The channels of increasing width are best seen in sequence 1104.

These experiments used a mixture of water (39.8%), glycerol (59.7%) and surfactant Micro90 (0.5%). For each sequence 1102-1104, a bubble with diameter D is held and guided by groove of width W. For all cases, channel height is H=0.4 mm, groove depth is T~0.2 mm. Average flow velocity is approximately 20 mm/s. Bubble velocities in channel $u_B$~12 mm/s, in groove $u_B$~8 mm/s. For sequence 1102, D=1.5 mm and the bubble was trapped by a groove having W=0.8 mm. For sequence 1103, D=0.7 mm, and the bubble was trapped by a groove, W=0.5 mm. For sequence 1104, D=0.4 mm. As indicated by the arrows in sequence 1104, the bubbles skip the groove. In this case, the bubble diameter is approximately the same as the channel height, and so the bubble is not significantly distorted. As a result, the flow forces acting on the bubble are greater than the surface tension forces acting on the bubble, and the bubble is more likely to skip the grooves.

The use of elongated grooves does not require significant secondary flow motion in the primary channel to control or transport the bubbles. However, such secondary flow can be created to the extent desired, e.g., by adding grooves, adjusting groove angle, etc. There is a possibility that bubbles that are too small to be trapped by the groove can still interact with the secondary flow, causing a net lateral motion. This behavior is illustrated in sequence 1104, where the bubble skips the grooves as described above. However, the secondary flows of the channels may be sufficient to guide the bubble upwards somewhat as seen in the sequence. This additional mechanism of bubble guiding may be an alternate means to facilitate removal of smaller bubbles from an inkjet print head.

Figure 12:
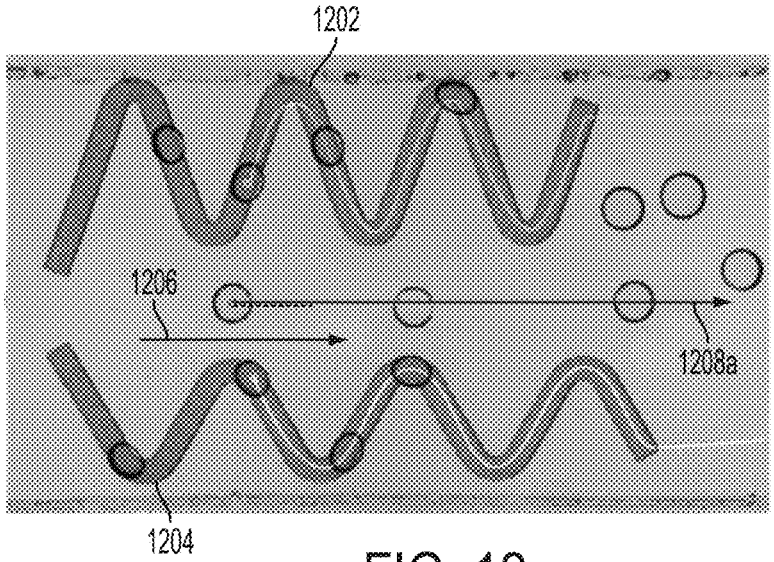
FIGS. 12 and 13 are photographs of a test fixture illustrating channel grooves according to another example embodiment.
Figure 13:
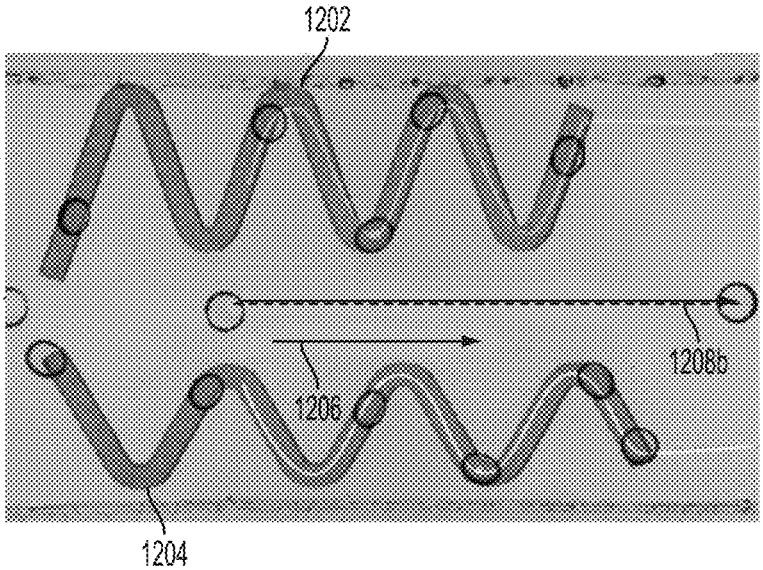

In reference now to FIGS. 12 and 13, photographs of a test fixture illustrate channel grooves according to another example embodiment. In these figures, grooves 1202, 1204 are sawtooth shaped, having a repeated pattern of straight "legs" angled relative to the flow (represented by arrow 1206) joined by curved sections. The effective velocity in the direction of flow is 12.6 mm/s in the center of the channel (indicated by arrows 1208*a* and 1208*b*). It the upper groove 1202, the effective velocity in the direction of flow is 3.4 mm/s, and in the lower groove 1204 this velocity is 5.8 mm/s. The photos of FIGS. 12 and 13 were taken at two different times.

Grooves 1202, 1204 as shown in FIGS. 12 and 13 can be used to move bubbles in a direction nearly perpendicular to the flow. As with multiple grooves, if a bubble skips one leg of the sawtooth groove, it may still be captured by other downstream legs of the groove. Curved grooves such as these can be configured to trap bubbles, slow down advance of the bubbles in the flow direction 1206, and shunt bubbles to specific locations. Slowing the motion of the bubbles, along with deterministic control of the bubble trajectory using curved grooves, allows for enhanced trapping features that can coalesce bubbles along the curved grooves. The coalesced bubbles may be large enough to purge from the head using less ink mass and/or be large enough to be captured and removed by other grooves, e.g., as shown in FIGS. 5-9.

Tailoring of the channel shapes to maximize bubble capture efficiency while reducing pressure drop. The groove can be optimized for trapping bubbles based on the Capillary number condition of the groove. As such, a variety of cross-sectional shapes may be utilized so long as they satisfy the characteristic dimension, w, for bubble interaction. This has practical implications for manufacturing. For example, where print heads are fabricated using a laminated set of plates that define flow channels, perfect rectangular cross sections may not be possible within desired manufacturing tolerances. Even so, the channel cross-sections can still be tailored to reduce pressure drop even further and/or to enhance the bubble interaction.

Figure 14:
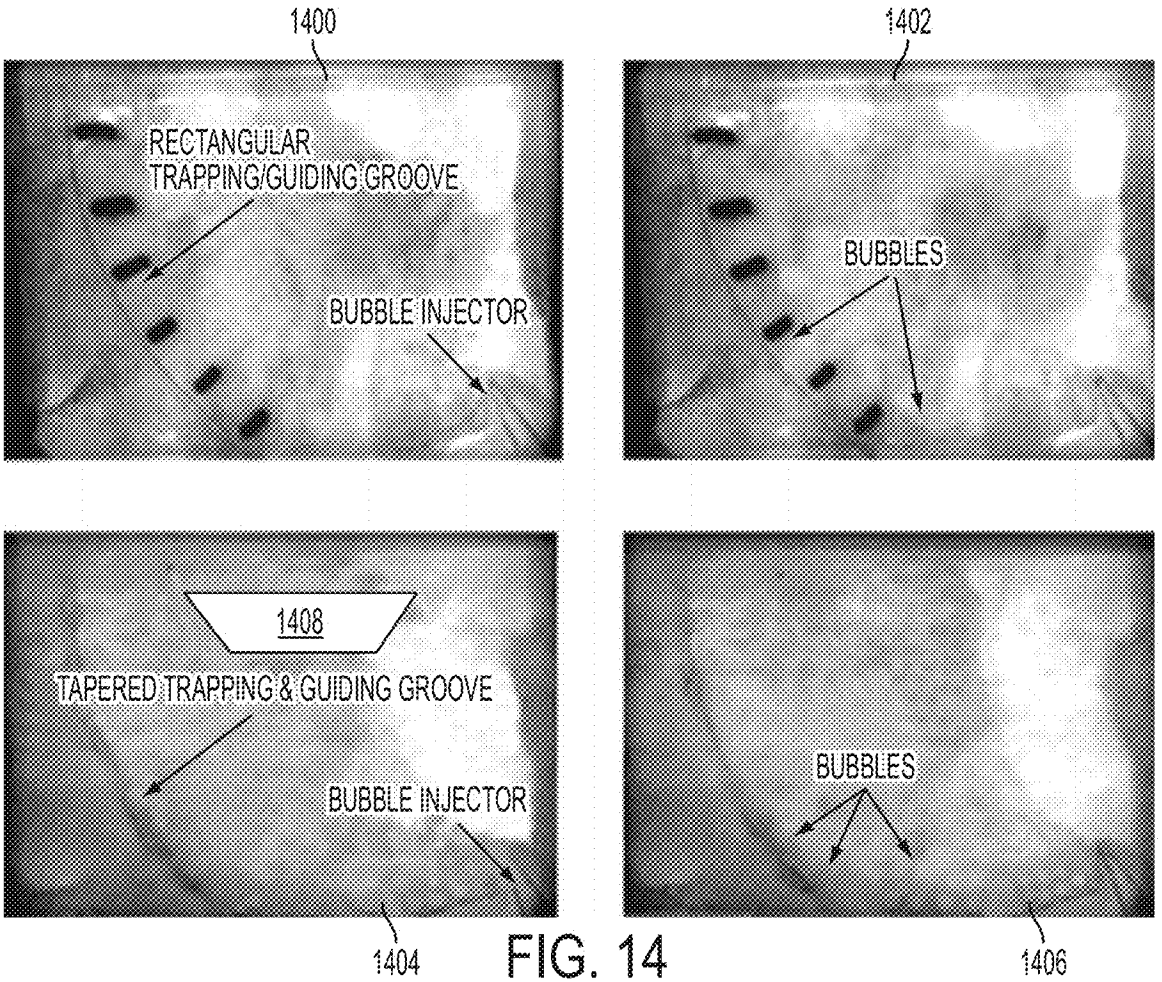
FIG. 14 is a series of photographs showing results of bubble removal tests for a grooved manifold according to an embodiment.

To illustrate the relative shape independence of bubble removal channels, tests were performed using channels that had tapered edges (troughs with angled sides) as opposed to rectangles. In FIG. 14, photographs show results of these tests for grooves according to an embodiment. In images 1400, 1402, molten solid ink flows through a flow path having rectangular guiding/trapping grooves on a lower surface. In images 1404, 1406, molten solid ink flows through a flow path having tapered guiding/trapping grooves (e.g., similar to shape 1408 overlaid on image 1404) on a lower surface grooves. In both cases, bubbles were injected from a port at the lower right hand corner. The rectangular and tapered channels these channels were equally effective at trapping and guiding bubble as rectangular channels of the same depth. The tapered channels would be expected to have slightly lower flow resistance due a modest increase in hydraulic diameter.

Figure 15:
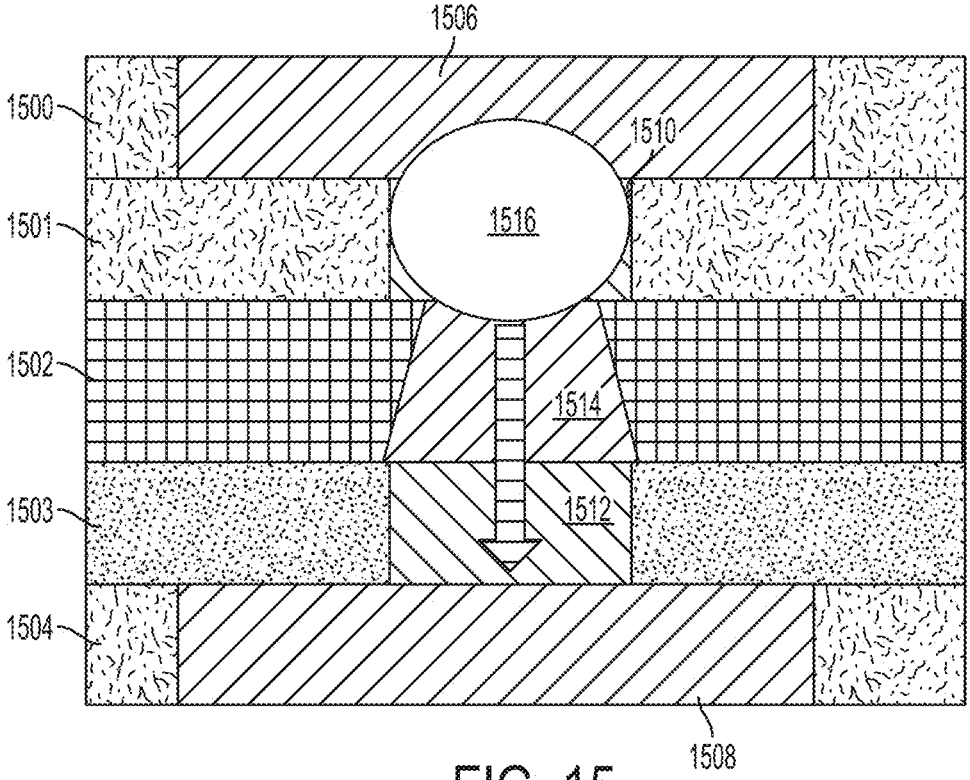
FIG. 15 is a cross-sectional diagram illustrating a bubble transport via according to an example embodiment.

Another bubble control feature that may be used with elongated channels involves passive bubble wicking through different layers. Some print heads are made using layered plates, and so it is possible to create vias between channels. In FIG. 15, a cross-sectional diagram illustrates a bubble transport via according to an example embodiment. Layers 1500-1504 are plates with voids that form ink transport flow paths 1506, 1508. Elongated grooves 1510, 1512 are at the bottom or top of respective first and second flow paths 1506, 1508. A tapered via 1514 through layer 1502 connects the elongated grooves 1510, 1512, and a bubble 1516 is able to pass through the via 1514 as indicated by the arrow.

In response to ink flow and/or buoyancy, the bubble 1516 moves from first flow path 1506 to trapping/guiding groove 1510. With correctly sized tapered via 1514 in the bottom of guide groove 1510, the bubble 1516 passively migrates to the trap/guide 1514 and be taken to a vent via second flow path 1508. In this context, "passive" refers to surface tension forces being dominant, as some amount of pressure drop may be present to push the bubbles through the contraction at the junction of 1501 and 1502. Once the bubble 1516 enters the tapered via 1514, the expansion will lead to the bubble moving into bottom chamber. The via 1514 may be elongated in/out of the page, and the width may be varied along this direction.

The via 1514 may be configured as a tapered groove that passively drives bubbles to another layer, allowing for the possibility of layer to layer bubble transport. Superimposed with flow or buoyant motion, the use of a through-layer via 1514 make it possible to drive bubbles along complex trajectories to venting locations in a manner not possible in current architectures and reduce the amount of ink required to transport a bubble to a vent.

While the illustrated arrangement shows grooves 1510, 1512 in both first and second flow paths 1506, 1508, the second groove 1512 may be optional. In such a case, the via 1514 will couple the first groove 1510 to the second flow path 1508. This may facilitate making the stack of layers smaller, and if the second flow path 1508 is special-purpose, e.g., dedicated to venting bubbles, stalling of bubbles in the flow path may not be as critical as in the first flow path 1506

Figure 16:
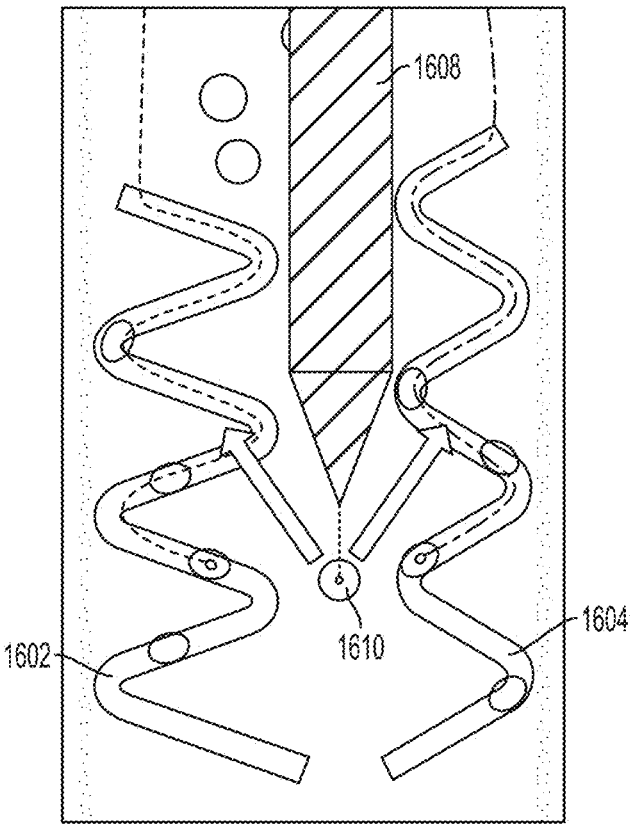
FIG. 16 is a plan view showing an ink flow path region according to another example embodiment.

In FIG. 16, a plan view shows an ink flow path region according to another example embodiment. The flow path includes sawtooth grooves 1602, 1604 similar to grooves shown in FIGS. 12 and 13. An obstruction 1608 is located in the flow path, and may extend partially or fully from the top to the bottom of the planar flow path. As a result of the obstruction 1608, a bubble 1610 will take the path of least resistance and enter the one of the grooves 1602, 1604, depending on initial position. A variety of shapes are possible for the obstruction 1608, but in general it would be desirable to use geometries that do not introduce stagnation points that the bubbles can get stuck on if the goal is steering of buoyant motion.

Figure 17:
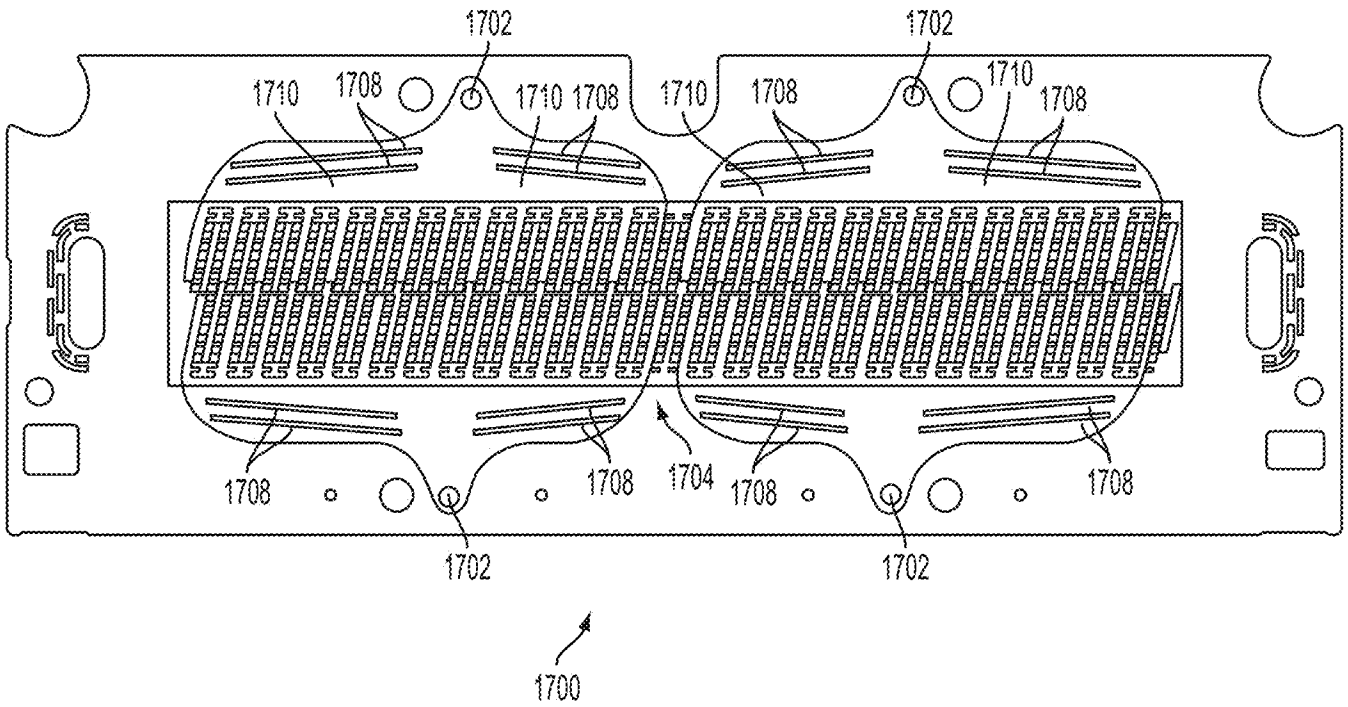
FIG. 17 is a plan view of a manifold illustrating bubble management features according to another example embodiment.

In FIG. 17, a plan view of a manifold 1700 illustrates bubble management features according to another example embodiment. Generally, ink flows from supply ports 1702 to finger manifolds 1706. Elongated grooves 1708 are located along at least one planar surface of the manifold. Bubbles moving from the supply ports 1702 to the finger manifolds 1704 will be trapped and guided by the grooves 1708.

The trapping and guiding of bubbles by the grooves 1708 may be made more effective by the application of time dependent pressure ramp profiles to remove bubbles during a purge cycle. These pressure profiles can include pulses of varying length, allowing for "stepwise" motion of the bubbles—e.g., the bubble is convectively transported a distance, then rises due to buoyancy. This variation in bubble motion can be exploited in combination with the trapping/guiding grooves 1708 to maximize trapping efficiency and minimize the amount of ink required to remove the bubble.

In the illustrated manifold, bubbles rise due to buoyancy and may be stuck, e.g., in manifold regions 1710, unless the purging pulse is long enough to fully vent the bubbles. In such a scenario, the guiding grooves 1708 can trap the bubbles and allow for passive venting by buoyancy. Other embodiments described herein may also utilize grooves in combination with time-dependent flow to assist in purging. For example, a device utilizing the serpentine grooves shown in FIGS. 12, 13 and 16 could be driven with a time-dependent, pressure ramp purge profile. When bubble motion slows between pulses, buoyant forces will drive coalescence of bubbles, making a larger bubble with a larger rise speed, allowing for a more rapid purge.

Figure 18:
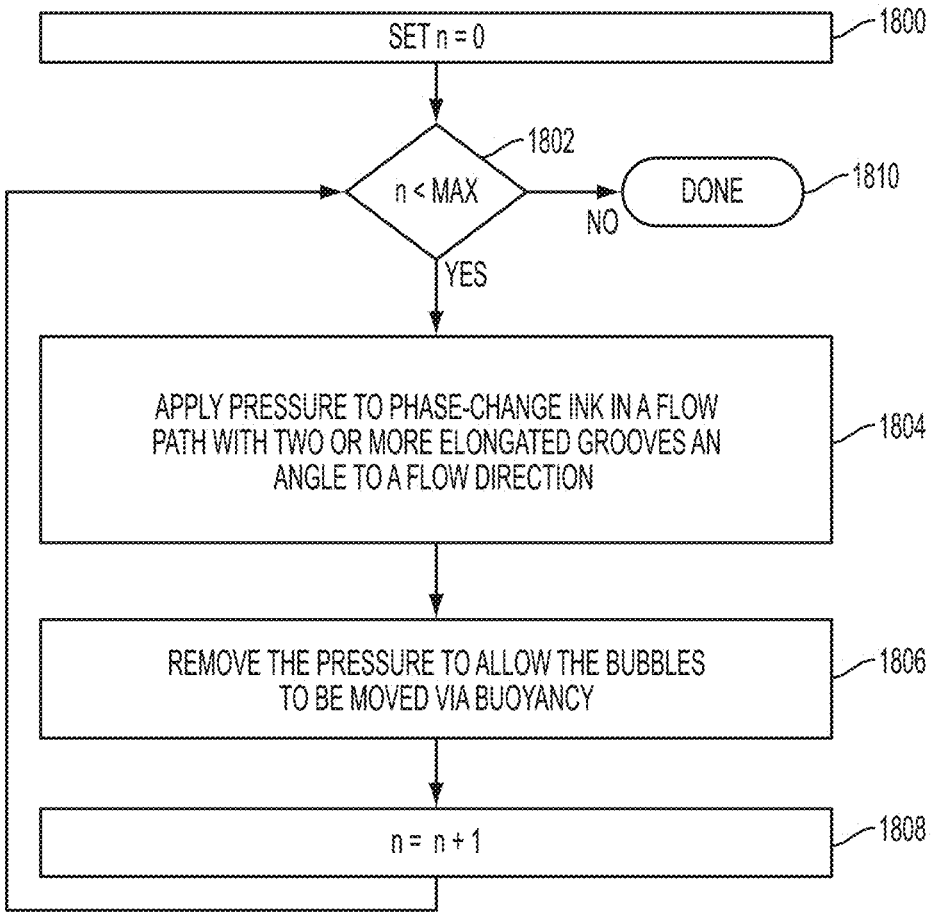
FIG. 18 is a flowchart illustrating a method according to an example embodiment.

In reference now to FIG. 18, a flowchart illustrates a method, according to an example embodiment. The method generally involves repetitively pressure pulsing an ink flow path. A counter is initialized 1800, the counter being checked at 1802 to determine whether a maximum number of repetitions has been performed, upon which the routine exits 1810. The maximum value may be static or dynamic, and other exit criteria may be used.

The pulsing involves a period where pressure is applied 1804 to phase-change ink in a flow path. The flow path has two or more elongated grooves in at least one of the top and bottom planar surfaces, the grooves being at an angle to a flow direction and having a threshold capillary dimension that results in a surface tension force acting on bubbles being less than a force of the flow acting on the bubbles such that the bubbles are directed along the elongated groove. During another period, the pressure is removed 1806, allowing the bubbles to be moved via buoyancy. The counter is incremented at 1808, such that the applying 1804 and removal 1806 of pressure is repeated a plurality of times.

Unless otherwise indicated, all numbers expressing feature sizes, amounts, and physical properties used in the specification are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

The foregoing description of the example embodiments has been presented for the purposes of illustration and description. It is not intended to be exhaustive or to limit the inventive concepts to the precise form disclosed. Many modifications and variations are possible in light of the above teaching. Any or all features of the disclosed embodiments can be applied individually or in any combination are not meant to be limiting, but purely illustrative. It is intended that the scope be limited not with this detailed description, but rather determined by the claims appended hereto.

What is claimed is:

1. A print head comprising:

an inlet port that receives a flow of a phase-change ink;

an outlet port that delivers the flow to a jet; and a flow path along a flow direction from the inlet port to the outlet port, the flow path comprising:

top and bottom planar surfaces; and two or more elongated grooves in at least one of the top and bottom planar surfaces, the two or more elongated grooves at an angle to the flow direction, the elongated grooves comprising a threshold capillary dimension such that bubbles in the phase-change ink are directed along the elongated grooves, wherein the threshold capillary dimension is satisfied if $\mu UH/\sigma*w<1$, wherein $\mu$ is a fluid viscosity of the phase-change ink, U is a characteristic fluid velocity in the flow path, H is a height of the flow path, $\sigma$ is a surface tension of the bubbles, and w is a length scale of the bubbles.

2. The print head of claim 1, wherein the flow is driven by buoyancy.

3. The print head of claim 1, wherein the flow is driven by a pressure differential between the inlet port and the outlet port.

4. The print head of claim 1, wherein the elongated grooves are spaced apart such that any of the bubbles that are pushed past a first of the elongated grooves by the flow are captured by a second of the elongated grooves.

5. The print head of claim 1, further comprising:

a second planar flow path separated from the flow path by a layer; and a tapered via through the layer joining at least one elongated groove of the flow path and the second planar flow path, wherein the bubbles are directed through the tapered via to the second planar flow path.

6. The print head of claim 5, wherein the second planar flow path directs the bubbles to a vent.

7. The print head of claim 5, wherein the second planar flow path comprises a second elongated groove having the threshold capillary dimension, the tapered via joining the at least one elongated groove with the second elongated groove.

8. The print head of claim 1, further comprising an obstruction in the flow path between two of the elongated grooves, the obstruction causing the bubbles to be directed to one or the other of the two elongated grooves.

9. The print head of claim 1, further comprising a vent, wherein the elongated grooves are disposed to direct the bubbles to the vent.

10. The print head of claim 9, wherein the bubbles are directed to the vent responsive to a pulse of flow pressure followed by a period of no flow pressure, wherein buoyancy forces during the period of no flow pressure guide the bubbles along the elongated grooves towards the vent.

11. The print head of claim 1, wherein the elongated grooves induce a secondary flow in the flow path, the secondary flow causing smaller bubbles to be moved in a direction along the elongated grooves, the smaller bubbles being too small to be trapped by the elongated grooves.

12. A method, comprising:

applying pressure to phase-change ink in a flow path, the flow path comprising top and bottom planar surfaces, and two or more elongated grooves in at least one of the top and bottom planar surfaces, the two or more elongated grooves at an angle to a flow direction and comprising a threshold capillary dimension such that bubbles in the phase-change ink are directed along the elongated grooves, the threshold capillary dimension being satisfied if $\mu UH/\sigma*w<1$, wherein $\mu$ is a fluid viscosity of the phase-change ink, U is a characteristic fluid velocity in the flow path, H is a height of the flow path, $\sigma$ is a surface tension of the bubbles, and w is a length scale of the bubbles; and removing the pressure to allow the bubbles to be moved via buoyancy, wherein the applying of the pressure and the removing of the pressure are repeated a plurality of times.

13. The method of claim 12, wherein the moving of the bubbles via buoyancy causes the bubbles to coalesce into larger bubbles.

14. The method of claim 12, further comprising obstructing the flow path between two of the elongated grooves to cause the bubbles to be directed to one or the other of the two elongated grooves.

15. A print head comprising:

first and second planar flow paths separated by a layer, the first planar flow path comprising two or more elongated grooves in a planar surface, the two or more elongated grooves at an angle to a flow direction of a phase-change ink, the elongated grooves comprising a threshold capillary dimension that results in a surface tension force acting on bubbles being greater than a force of the flow acting on the bubbles such that the bubbles are directed along the elongated grooves, wherein the threshold capillary dimension is satisfied if $\mu UH/\sigma * w<1$, wherein $\mu$ is a fluid viscosity of the phase-change ink, U is a characteristic fluid velocity in the flow path, H is a height of the flow path, $\sigma$ is a surface tension of the bubbles, and w is a length scale of the bubbles; and a via through the layer joining at least one elongated groove of the first planar flow path to the second planar flow path, wherein the bubbles are directed through the via to the second planar flow path by the flow.

16. The print head of claim 15, wherein the second planar flow path comprises a second elongated groove having the threshold capillary dimension, the via joining the at least one elongated groove with the second elongated groove.

17. The print head of claim 16, wherein the via is tapered.

18. The print head of claim 15, wherein the second planar flow path directs the bubbles to a vent.

* * * * *